United States Patent [19]

Yang et al.

[11] Patent Number: 4,581,611

[45] Date of Patent: Apr. 8, 1986

[54] CHARACTER DISPLAY SYSTEM

[75] Inventors: Chin-Cheng Yang; Shinsaku Fujikawa, both of Hiratsuka; Masashi Utsumi, Isehara, all of Japan

[73] Assignee: NCR Corporation, Dayton, Ohio

[21] Appl. No.: 677,115

[22] Filed: Nov. 30, 1984

[30] Foreign Application Priority Data

Apr. 19, 1984 [JP] Japan ..... 59-77643

[51] Int. Cl.[4] ..... G09G 1/16

[52] U.S. Cl. ..... 340/750; 340/748; 340/723; 340/799

[58] Field of Search ..... 340/720, 723, 744, 748, 340/750, 798, 799, 802

[56] References Cited

U.S. PATENT DOCUMENTS

| | | | |
|---|---|---|---|
| 3,753,240 | 8/1973 | Merwin . | |
| 4,070,664 | 1/1978 | Abe . | |
| 4,093,996 | 6/1978 | Hogan et al. | 364/900 |
| 4,104,624 | 8/1978 | Hamada | 340/750 |
| 4,117,469 | 9/1978 | Levine | 340/750 |
| 4,127,851 | 11/1978 | Middel . | |
| 4,223,353 | 9/1980 | Keller et al. | 358/230 |
| 4,236,153 | 11/1980 | Aling | 340/756 |
| 4,237,543 | 12/1980 | Nishio et al. | 364/900 |
| 4,278,974 | 7/1981 | Kondo | 340/784 |
| 4,356,482 | 10/1982 | Oguchi | 340/731 |
| 4,359,730 | 11/1982 | Kunikane et al. | 340/792 |
| 4,379,293 | 4/1983 | Boisvert et al. | 340/750 |
| 4,388,621 | 6/1983 | Komatsu et al. | 340/750 |
| 4,399,435 | 8/1983 | Urabe | 340/750 |
| 4,408,197 | 10/1983 | Komatsu et al. | 340/720 |
| 4,418,343 | 11/1983 | Ryan et al. | 340/723 |
| 4,434,472 | 2/1984 | Kachun | 364/900 |
| 4,468,662 | 8/1984 | Tanaka | 340/750 |
| 4,482,979 | 11/1984 | May | 340/750 |
| 4,485,378 | 11/1984 | Matsui et al. | 340/750 |
| 4,511,965 | 4/1985 | Najoram | 340/750 |

FOREIGN PATENT DOCUMENTS 0105725 4/1984 European Pat. Off. .

*Primary Examiner*—Gerald L. Brigance

*Attorney, Agent, or Firm*—Wilbert Hawk, Jr.; Albert L. Sessler, Jr.; George J. Muckenthaler

[57] ABSTRACT

A cathode ray tube of long persisting time has a control unit operably associated with a central processing unit and a CRT controller wherein the control unit generates signals to select data bus and memory access. A video inhibit signal is generated for a predetermined period of time by the control unit to avoid or prevent flicker or flashing on the screen during refreshing thereof.

17 Claims, 4 Drawing Figures

CHARACTER DISPLAY SYSTEM

BACKGROUND OF THE INVENTION

In a conventional cathode ray tube (CRT) display device, it is generally known that it is necessary to repeatedly refresh the screen on the CRT, normally on the order of 50–60 times per second, in order to maintain the displayed state and in the manner wherein a controller sequentially reads out all addresses in a refresh memory. In addition, it is also necessary to access the refresh memory from a central processing unit (CPU) for any modification of the screen-displayed content and for other purposes. However, competitive accessing the refresh memory from or by the central processing unit and the controller causes a flash or like flicker to be generated or present on a portion of the screen.

In order to avoid this flashing or flickering on the screen, an MC 6800 series synchronous bus system, as manufactured by Motorola Corporation, Schaumberg, Ill., and including a system clock, has been developed or contrived so as to access the memory from the central processing unit during the time when the system clock is at a high level, and to access the memory from the controller during the time when the system clock is at a low level. On the other hand, in the case of an asynchronous bus system having no system clock, such as the Z-80 type, as manufactured by Zilog Corporation, Cupertino, Calif., the memory is preferably accessed from the central processing unit during the horizontal or during the vertical blanking periods. However, according to this latter method, accessing from the central processing unit is limited to short-time blanking periods, and it is seen that a draw-back or disadvantage of such method is that the processing speed of the central processing unit is reduced.

In the prior art and as a solution to these draw-backs, there has been proposed a technique described in Japanese Laid-Open Patent Specification No. 66,989/83 wherein reference clocks in the central processing unit and the cathode ray tube controller are synchronized in alternating manner so as to permit the memory access from the CPU only during the time when the reference clock of the CRT controller is at a low level, and to permit the memory access from the CRT controller only during the time when the reference clock of the controller is at a high level, thereby avoiding the competitive accessing from or by the CPU and the CRT controller. However, in this arrangement, the reference clock in the CRT controller is divided into halves so as to assign individual halved periods as access time of the CPU and the CRT controller so that as to refresh memory access and its associated peripheral circuit elements, it was necessary to use high speed elements capable of operating at least in a period which is one-half the conventional period. Further, the reference clocks of the CPU and the CRT controller have been controlled so as to operate in synchronized manner in order to avoid such competitive accessing with the result that the structure of the control unit and the peripheral units was complicated or complex in nature.

Further documentation in the field of video display systems includes U.S. Pat. No. 3,753,240, issued to R. L. Merwin on Aug. 14, 1973, which discloses a data entry and retrieval composite display system wherein electronic means transforms film, microfiche, transparent slides, and video tape data into a video signal and combines such signal with computer originated data which is reduced to a video signal and then displays the combined signals as a composite video display.

U.S. Pat. No. 4,070,664, issued to M. Abe on Jan. 24, 1978, discloses a display system having separated display periods and key input periods wherein a computing module generates a repeating sequential series of first pulses and a group of second pulses for energizing a display device. During a first period of predetermined time interval, the display device is driven by first and second pulses while during a second period of the time interval, the display device is not driven but the timing pulses are coupled to the computing module.

U.S. Pat. No. 4,093,996, issued to W. J. Hogan et al. on June 6, 1978, discloses a cursor circuit for a television display having an intermediate buffer and a refresh buffer. The cursor circuit secures the identity of the encoded symbol in the intermediate buffer during the first display frame and this identity is the address of the symbol as stored in the refresh buffer. This identity is made available for accessing the refresh buffer during a second display frame.

U.S. Pat. No. 4,127,851, issued to A. P. Middel on Nov. 28, 1978, discloses a device for displaying a number of lines of characters and has a circulating store for one line of characters connected to the output of a buffer store for the entire image information. An output of the circulating store is input to the buffer store and is switched from its output to the output of the circulating store so that information in the buffer store is shifted.

U.S. Pat. No. 4,223,353, issued to John T. Keller on Sept. 16, 1980, discloses a video display device having a memory for storing intensity values and connected with the memory is a persistor which decreases the intensity values as a function of time. Also connected with the memory is an input for increasing specific intensity values in response to receipt of input data corresponding to a particular display pixel.

U.S. Pat. No. 4,236,153, issued to W. Aling on Nov. 25, 1980, discloses a low-noise character element display device wherein the display elements are periodically and gradually switched on and off and the information is changed or displaced at instants that the display elements are switched off.

U.S. Pat. No. 4,237,543, issued to Y. Nishio et al. on Dec. 2, 1980, discloses a microprocessor controlled display system having a data control unit including a microprocessor and an associated memory, a refresh memory unit connected to the data control unit through an address bus and a data bus, and a video control unit for accessing display data stored in the refresh memory unit by a timing control unit to produce a video signal. The refresh memory unit comprises memories sectioned by byte, an I/O controller which receives a read/write control signal to indicate whether the access by the data control unit is read access or write access, and an access memory specifying signal to indicate one or two byte memory access to produce an I/O control signal, and a memory controller responsive to the I/O signal to control data access to the memories.

U.S. Pat. No. 4,278,974, issued to K. Kondo on July 14, 1981, discloses a driving system for a matrix display device having X and Y electrodes with a timing signal generator for controlling the X scanning signals, and a display signal converter for converting display information into a portion of signals for display. A memory device stores the signals for display and the drive to the Y electrodes is inhibited while information is being stored in the memory.

U.S. Pat. No. 4,356,482, issued to T. Oguchi on Oct. 26, 1982, discloses an image pattern control system having a dynamic memory which operates during a first period to read and rewrite the contents of memory according to address data sent from an address register and to refresh stored data according to the output of a refresh counter during a second period. The first and second periods are switched according to the output of a zoom hold register.

U.S. Pat. No. 4,359,730, issued to A. Kunikane et al. on Nov. 16, 1982, discloses an alphanumeric information display system controlled by a microprocessor wherein first and second memory means are accessed in pre-determined periods of time to provide a display shifted by a number of characters on a word-for-word basis.

U.S. Pat. No. 4,379,293, issued to C. Boisvert et al. on Apr. 5, 1983, discloses a CRT controller connected to a processor and having a refresh address generator to refresh display on the CRT, an update address generator to update information in refresh memory, and a control circuit for connecting the update address generator and the refresh address generator to refresh the memory so that only one of the generators has control of the refresh memory at a time.

U.S. Pat. No. 4,399,435, issued to K. Urabe on Aug. 16, 1983, discloses a digital data display apparatus wherein data are stored in a refresh memory and displayed on a CRT and the apparatus includes a first and a second buffer memory so that data read out from the refresh memory can be stored by odd and even rows. When display data in the first or second memory are displayed in odd or even rows on the display screen, the horizontal period of that row is used to read out display data for the other row from the refresh memory, and store the same in the second or first buffer memory. The display data are alternately stored in and read-out from the first and second buffer memories so that all data can be displayed over the entire area of the display screen.

U.S. Pat. No. 4,408,197, issued to S. Komatsu et al. on Oct. 4, 1983, discloses a pattern display apparatus for use with a CRT and having a composite video signal synthesizer, a memory for storing pattern data, a mode setting circuit for the memory, a data selection signal generator, and a raster line number signal generator. The memory stores data for simple patterns such as alphabetical letters, and those for relatively complicated patterns such as Chinese characters in individual areas in the memory addresses are identified by a combination of data selection and raster line number signals supplied to the memory from the respective generators.

U.S. Pat. No. 4,418,343, issued to J. L. Ryan et al. on Nov. 29, 1983, discloses a CRT refresh memory system which has a CPU, a memory unit, a video control system, a timing control system, and a communication system each connected to the others by common system address, data, and control buses. The accessing of a display memory by both the CPU and the video control system over the common address bus is accommodated without the need for multiplexing the system address bus or compromising either the system data transfer rates or CPU instruction execution speeds.

And, U.S. Pat. No. 4,434,472, issued to L. Kachun on Feb. 28, 1984, discloses a terminal system including microprocessor controlled line refresh apparatus having addressable screen memory means for storing display data, temporary storage means for address data, incrementing means coupled to the memory means and supplied with display data address from the temporary storage, and microprocessor means for supplying data address to the temporary storage on a line-by-line basis in real time so that line refresh data supplied to the character generator may be varied by real time manipulation of line address data by the microprocessor means.

SUMMARY OF THE INVENTION

The present invention relates to display devices and systems and, more particularly, to a display unit for use with data processing or like systems. A cathode ray tube (CRT) of long persistence time or a long persisting CRT is used to avoid a flash or a flicker which sometimes appears on the screen when Chinese or like complex characters are displayed thereon. The present invention is constructed in such a manner that only the CRT controller monopolizes the refresh memory to sequentially read out addresses therefrom unless the access to the memory is not requested by the central processing unit (CPU). Data which is read out from the refresh memory by the CRT controller is stored in a latch circuit and a character generator produces a display pattern signal which is based on such data. The display pattern signal is converted into a serial data by a parallel-to-serial converter and is sent to the long persisting CRT as a video signal for controlling electron beams.

The control unit in the system of the present invention is constructed so as to generate and send out various control signals such as a select signal for switching an appropriate address bus when the access to the memory is requested by the CPU, a gate control signal for connecting and switching a data bus, and a video inhibit signal. When the CPU requests access to the refresh memory, the control unit sends the select signal to a multiplexer to switch the address bus from the CRT controller to the CPU and also sends the gate control signal to the gate to connect a data line of the memory with the data bus of the CPU. At the same time, the control unit sends a read or write signal to the refresh memory to permit the access to the memory from the CPU. The data stored in the latch when the CPU accesses the memory is not the data to be displayed on the CRT at that time, but is the data based on the access from the CPU so that sending a video signal which is generated in form as based on this data to the long persisting CRT causes a flash to appear on the CRT screen. In order to avoid the flashing, the control unit sends the video inhibit signal for a pre-determined period of time after the access is requested by the CPU to inhibit the video signal from being sent out from the parallel-to-serial converter. Thus, a portion of the screen will not flicker owing to the visual persistence effect of the long persisting CRT even though the sending out of the video signal is inhibited for the pre-determined period of time.

In accordance with the above discussion, the principal object of the present invention is to provide a display system capable of displaying an image and maintaining operating time without use of high-speed refresh memory means and peripheral circuit elements.

Another object of the present invention is to provide a CRT display device having long persisting time and generating inhibit means to reduce or substantially eliminate any flashing or flickering on the screen.

An additional object of the present invention is to provide a CRT display device of simple construction and utilizing an asynchronous bus system operably associated with microprocessor and controller means.

A further object of the present invention is to provide a control unit in a display system which selects the address bus, connects a data line of memory with the data bus of the CPU, and generates an inhibit signal for a pre-determined period of time to prevent flash or flicker on the screen.

Additional advantages and features of the present invention will become apparent and fully understood from a reading of the following description taken together with the annexed drawing.

DESCRIPTION OF THE PREFERRED EMBODIMENT

Figure 1:
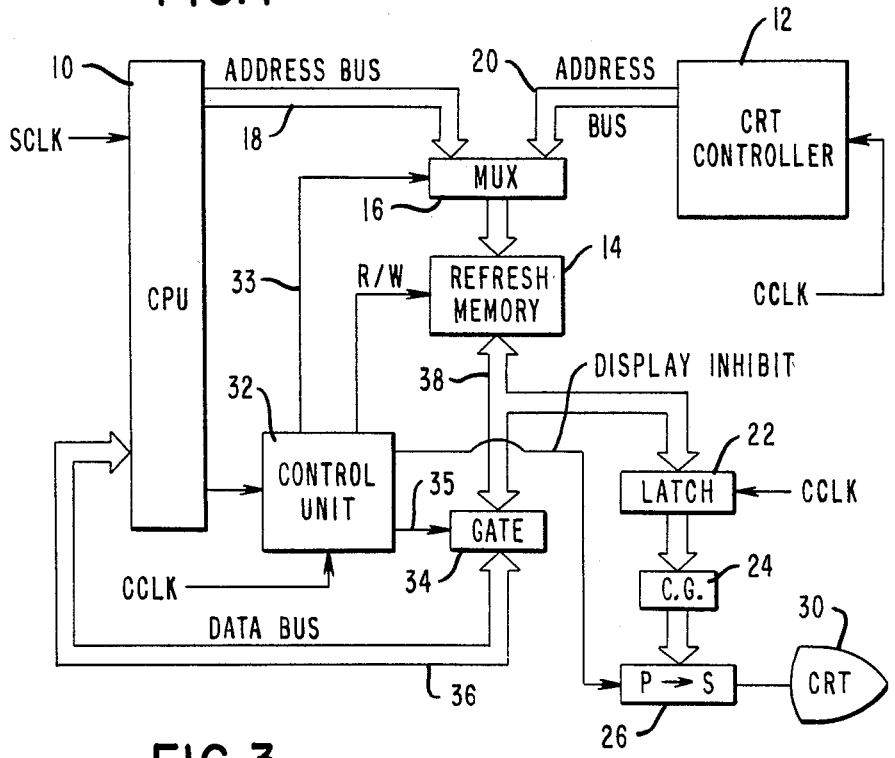
FIG. 1 is a block diagram illustrating the diagrammatic structure of the device according to the present invention.

FIG. 1 is a block diagram illustrating the diagrammatic structure of an embodiment of the present invention wherein 10 is a central processing unit or CPU using an SCLK as the reference clock signal, 12 is a cathode ray tube or CRT controller using a CCLK as the reference clock signal, 14 is a CRT refresh memory for storing data required for the CRT screen display and 16 is a multiplexer for switching an address bus 18 from the CPU 10 and an address bus 20 from the controller 12 so as to connect either one of the buses to the memory 14. A latch circuit 22 is controlled by the reference clock CCLK to latch the data on a data line of the memory 14. A character generator CG 24 sends a pattern signal of a character to be displayed in accordance with the data in the latch circuit 22, and a parallel-to-serial converter 26 converts the parallel display pattern signal sent from the character generator 24 into a serial signal to send it to a CRT 30 as the video signal. A long persisting CRT 30 uses fluorescent paint such as P-39 or the like to provide a CRT screen of long persistence time. A control unit 32 sends various control signals such as a select signal 33, a gate control signal 35, and a video inhibit signal DISPLAY INHIBIT according to the request from the CPU 10 to access the memory 14. A gate circuit 34 is provided between and connects a data bus 36 of the CPU and a data bus 38 of the memory 14.

The CRT controller 12 sequentially reads out the content of the refresh memory 14 while always counting up addresses one by one in accordance with the reference clock CCLK to refresh the display on the screen of the CRT 30. In the case wherein an access to the memory 14 is requested by the CPU 10, the control unit 32 sends the select signal to the multiplexer 16 to switch the address line to the address bus 18, sends the gate control signal to the gate circuit 34 to connect the data bus 36 and the data line 38 together and to access the memory 14 simultaneously therewith. The data on the data line 38 which is sent at that particular time is a read data in response to the request of the CPU 10 or is a write data sent from the CPU and is not the data intended for the CRT 30 display. However, the latch circuit 22 unconditionally latches the data on the data line 38 in accordance with the reference clock CCLK and the character generator 24 produces a display pattern signal based on the latch data in the latch and sends it to the parallel-to-serial converter 26. Then, if the converter 26 converts the display pattern signal into a serial signal and sends it to the CRT 30 as the video signal, a character which should not be displayed will be instantaneously displayed and thereby cause the flash to generate or appear on the CRT screen.

The DISPLAY INHIBIT signal is adapted to inhibit the sending out of the video signal for the predetermined period of time until a correct display pattern signal comes out, thereby preventing flashing on the screen. In the present invention, the long persisting CRT 30 is used so that a preferable display state can be maintained without flicker on the screen, owing to the visual persistence effect of the long-persisting CRT, even though the sending out of the video signal is stopped or delayed for the predetermined period of time.

Figure 2:
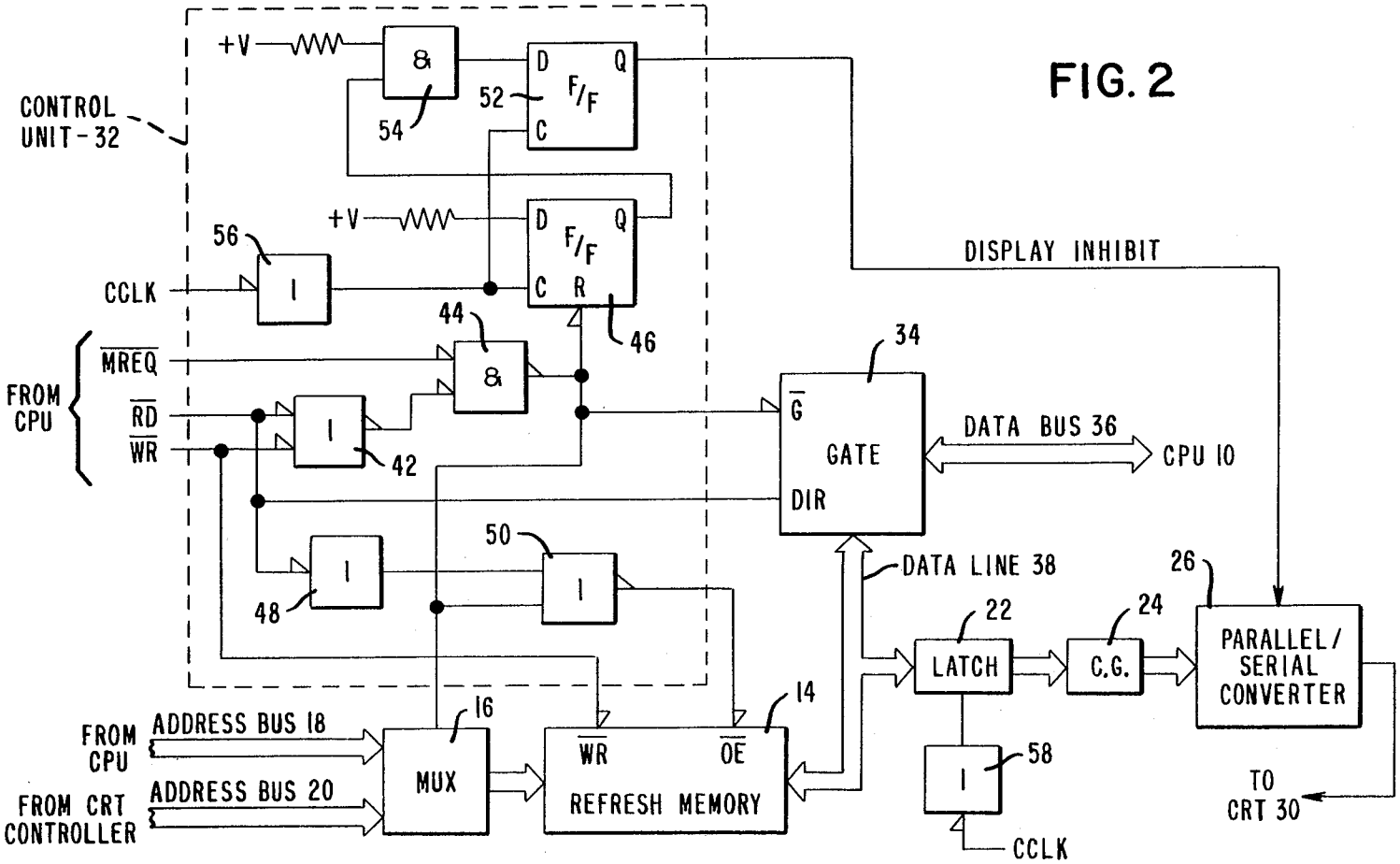
FIG. 2 is a logic diagram of the control unit of FIG. 1 and showing the relationship between the control unit and the peripheral elements thereof.

The control unit 32 is now described in detail with reference to FIG. 2 which is a diagrammatic block diagram illustrating the relationship between the control unit and the associated peripheral circuit elements. As seen in FIG. 2, a memory request signal $\overline{\text{MREQ}}$ and a read signal $\overline{\text{RD}}$ or a write signal $\overline{\text{WR}}$, the latter two signals being inverted through a gate 42, are input into an AND gate 44, the output of which is connected to a flip flop 46, to the gate circuit 34, and to the multiplexer 16. The read signal $\overline{\text{RD}}$ is input into the gate circuit 34 and is inverted by an inverter 48 to be input into a NOR gate 50 together with the output from the AND gate 44 and then to be supplied to the refresh memory 14. The write signal $\overline{\text{WR}}$ is directly supplied to the refresh memory 14.

The output of the flip flop 46 is connected to the input of a flip-flop 52 through an AND gate 54, and the output of the flip-flop 52 is connected to the parallel-to-serial converter 26 as a DISPLAY INHIBIT signal. The reference clock CCLK signal of the controller 12 is input through an inverter 56 to the clock inputs of the flip-flops 46 and 52. The reference clock signal CCLK is also provided to the latch circuit 22 through an inverter 58.

When the CPU 10 requests to access the refresh memory 14, that is, when signals $\overline{\text{MREQ}}$ and $\overline{\text{RD}}$ or $\overline{\text{WR}}$ signals go to the low level, the output from the gate 44 also goes to the low level which output is then sent to the multiplexer 16 and the gate circuit 34 as means for generating the select signal 33 and the gate control signal 35, whereby the switching of the address buses 18 and 20 and the connection between the data buses 36 and 38 are accomplished. Additionally, the $\overline{\text{RD}}$ signal is also being input into the gate 34 by which its connecting direction is switched in such a manner that the data from the memory 14 is sent to the CPU 10 in the read mode while the data from the CPU is written into the memory 14 in the write mode. At the same time, the $\overline{\text{RD}}$ or $\overline{\text{WR}}$ signal is sent to the refresh memory 14 thereby to read the data from or write the data into the memory.

When the output from the AND gate 44 is at the low level, the flip-flop 46 is directly reset by reason of which the flip-flop 52 is also reset at the next fall of the reference clock signal CCLK. When the flip-flop 52 is reset, the low output is sent to the parallel-to-serial converter 26 as the DISPLAY INHIBIT or video inhibit signal to inhibit the video signal from being sent to the CRT 30. The flip-flops 46 and 52 are sequentially set at each falling of the CCLK signal after the output from the AND gate 44 goes to the high level. In other words, the flip-flop 52 is set at the second falling edge of the CCLK signal after the output from the AND gate 44 goes to the high level and, hence, the video inhibit signal is not sent out.

Figure 3:
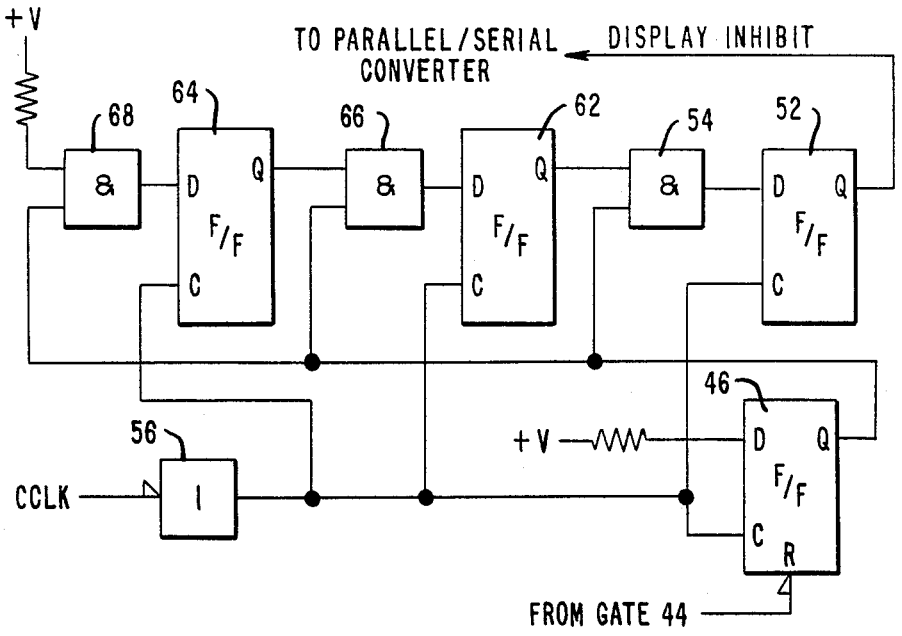
FIG. 3 is a logic diagram of one embodiment in which the sending time of the display inhibit signal is prolonged.

Although in this embodiment, the duration of the DISPLAY INHIBIT signal corresponds to that of two reference clock CCLK signals, the duration and the time of sending the video inhibit signal can be freely changed depending on the access time of the character generator 24 and the parallel-to-serial converter 26 and the necessity or requirement of the Chinese or like character display. For example, in order to display one Chinese character, it is necessary to continuously access the refresh memory 14 two times and, in relation thereto, it is necessary to send the video inhibit signal for a relatively longer time. Accordingly, and as illustrated in FIG. 3, it is also possible to send the video inhibit signal for a period of time corresponding to the period required for sending out four reference clock CCLK signals; for example, by additionally providing two flip-flops 62 and 64 along with associated AND gates 66 and 68 at the front stage of the AND gate 54 and of the flip-flop 52.

Figure 4:
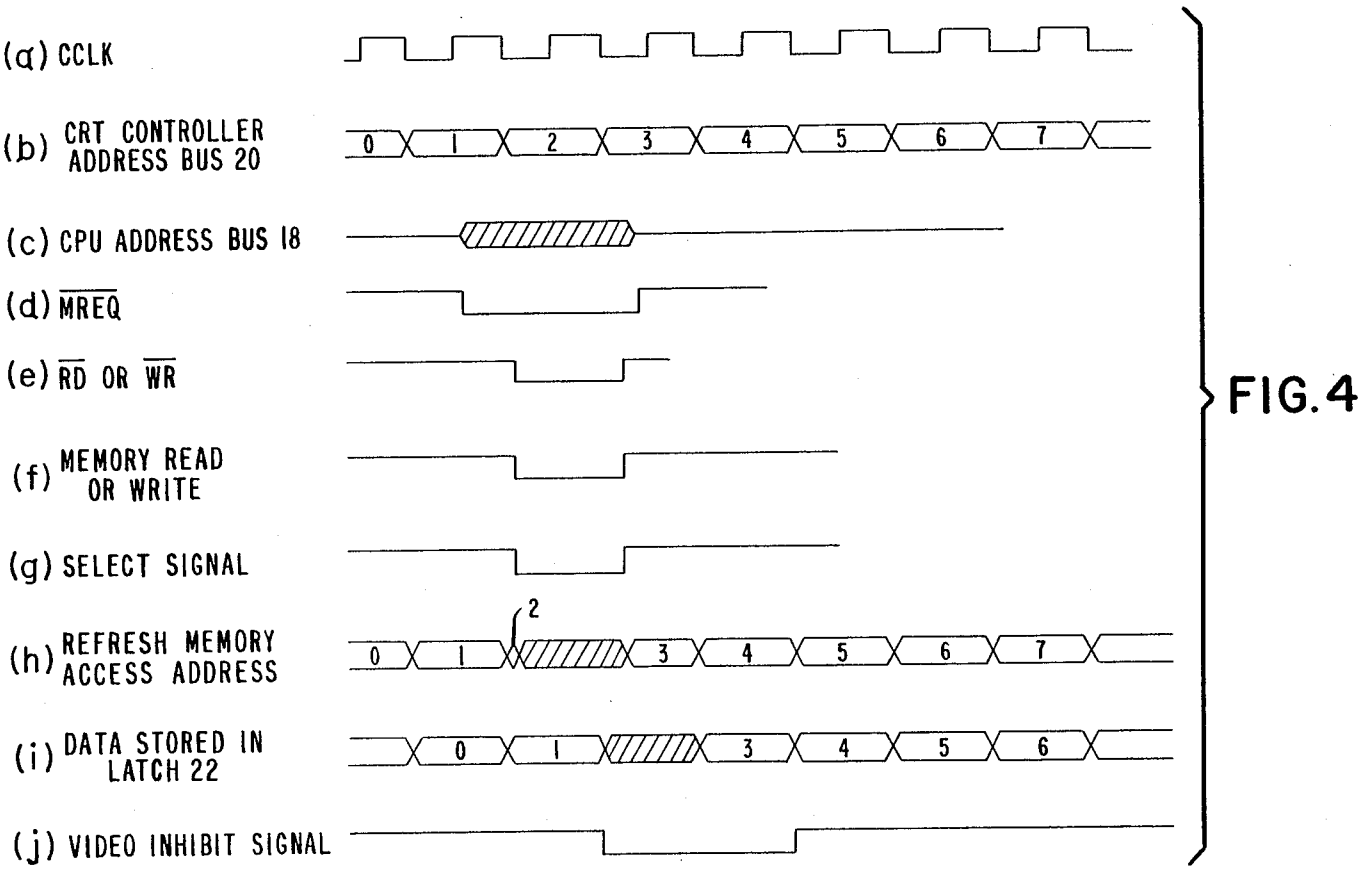
FIG. 4 is a timing diagram showing the various operation timings of the embodiment of FIG. 2.

FIG. 4 is a timing diagram illustrating various operation timings of the embodiment in FIG. 2. The controller 12 accesses the refresh memory 14 by sequentially counting up addresses in accordance with the reference clock CCLK signal. As shown in FIG. 4, when the memory request $\overline{\text{MREQ}}$ signal (d) and then the read $\overline{\text{RD}}$ signal or write $\overline{\text{WR}}$ signal (e) are sent from the CPU 10, the select signal (g) is immediately sent to the multiplexer 16 to switch the address buses 18 and 20. Since the address data is already sent on the address bus 18 of the CPU 10 as shown by FIG. 4(*c*), the memory read or memory write signal (f) is immediately sent out. In FIG. 4 (h) is shown the access address of the refresh memory 14 and (i) is the address of the data to be latched into the latch circuit 22. Since the data on the data line 38 is latched into the latch circuit 22 at the next falling of the CCLK signal, the latched data of the latch circuit and the now existing access data on the data line 38 are offset from each other for one cycle. Since the display pattern signal that is produced is based on the latched data of the latch circuit 22, the video signal is sent to the long persisting CRT 30, delayed by one cycle after the CPU 10 has accessed the memory. As shown by (h), the access from the CPU 10 is performed or accomplished in a manner that is unrelated to the reference clock CCLK signal so that incomplete memory access [see addresses 2 and 3 in FIG. 4(*h*)] is performed or accomplished before and after the access address (the shaded portion) of the CPU 10. Since the access time of the data read out by this incomplete access is short, the data of the next read-out address 3 in FIG. 4(*i*) is latched to the latch circuit 22 in spite of whether or not the data is correctly read out. Thus, as shown by FIG. 4(*j*), the video inhibit signal is being sent out during the time of access of data of the CPU 10 and during the time that data of the address 3 are being latched into the latch circuit 22, thereby inhibiting the sending out of the video signal from the parallel-to-serial converter 26 during that time.

It is seen in previous arrangements that, in order to process the access request of the CPU 10 without delay, the high and low periods of the reference clock corresponding to the CCLK signal as shown in FIG. 4(*a*) were respectively assigned as the access periods from the CPU 10 and the CRT controller 12 so that it was necessary to access at a half cycle of the CCLK signal and, hence, the high-speed elements were needed.

In the present invention, the CRT controller 12 reads out the addresses from the refresh memory 14 in a monopolizing manner when the access to the memory is not requested by the CPU 10, and the controller gives a priority to the CPU when the access is requested by the CPU and sends the video inhibit signal during that time whereby the full one cycle of the reference clock CCLK signal is assigned as the access time of the memory so that the present invention can provide the CRT display device in an arrangement capable of processing the access request of the CPU without delay even when elements of lower speed than those in the above-mentioned previous arrangements are used. Additionally, the flashing on the screen due to the generation of an incorrect video signal can be avoided and a preferable display state can be maintained by generating the video inhibit signal for inhibiting the sending out of the video signal based on the access data of the CPU 10 and by utilizing the visual persistence effect of the long persisting CRT 30. Further, according to the present invention, it is not necessary to synchronize the reference clock SCLK signal of the CPU 10 with the reference clock CCLK signal of the CRT controller 12 so that the CRT 30 display device of a simpler construction can be provided. Moreover, in the present invention, the CRT 30 display device is composed of a simpler structure by using low speed elements so that a lower-priced CRT display device can be provided.

It is thus seen that herein shown and described is a CRT display device in a character display system that substantially eliminates flicker or flash on the screen by utilizing a video inhibit signal operably associated with peripheral elements and with a long persisting CRT. The apparatus of the present invention enables the accomplishment of the objects and advantages mentioned above and, while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A device for displaying characters on a screen of a CRT, comprising a

CRT having long persistence time, memory means for storing display data and accessible for refreshing the CRT screen, microprocessor means connected with the memory means for accessing thereof in response to input information, CRT controller means for accessing said memory means to refresh images of data displayed on the CRT screen, signal generating means connected with the memory means for converting display information data into serial data, and control means connected with the memory means for signalling access thereto by the microprocessor means and for sending a video inhibit signal to the signal generating means, the video inhibit signal being maintained for a predetermined period of time after access is requested by the microprocessor means to inhibit video signals from being sent by the signal generating means.

2. The device of claim 1 wherein the memory means is a refresh memory for storing read and write data to be displayed.

3. The device of claim 1 wherein said microprocessor means is a central processing unit having priority over said CRT controller means to said memory means.

4. The device of claim 1 including parallel-to-serial converting means and wherein said signal generating means is a character generator coupled to the converting means for outputting display information.

5. The device of claim 1 including a multiplexer coupled to said microprocessor means and to said CRT controller means and accessed by said control means for selecting control of display data from said memory means by said control means.

6. The device of claim 1 wherein said memory means is a refresh memory for storing data and accessible by both the microprocessor means and the CRT controller means.

7. The device of claim 1 wherein the memory means includes a latch circuit for storing data accessible for display.

8. A CRT display device including refresh memory means for storing data to be displayed, microprocessor means for accessing said refresh memory means for data to be displayed, CRT controller means for accessing said refresh memory means to refresh images of data displayed on the screen of the CRT, means for controlling access to the refresh memory means by the microprocessor means and the CRT controller means, video signal generating means for producing output video signals dependent upon the data to be displayed, and a CRT of long persistence light-emission time for displaying images on the screen in accordance with the video signals, said access controlling means operable with said microprocessor means to enable same to periodically read out data from said memory means wherein request for access to the refresh memory means by the microprocessor means enables priority thereto over the CRT controller means and outputs a video inhibit signal to the video signal generating means to prevent output of video signals thereby for a predetermined period of time.

9. The CRT display device of claim 8 wherein the microprocessor means is a central processing unit having priority over the CRT controller means to access of the memory means.

10. The CRT display device of claim 8 wherein the signal generating means is a character generator coupled to a converter outputting information.

11. The CRT display device of claim 8 including a multiplexer coupled to the microprocessor means and to the CRT controller means and accessed by the access controlling means for selecting control of display data from the memory means by said access controlling means.

12. The CRT display device of claim 8 wherein the memory means includes a latch circuit for storing data accessible for display.

13. The CRT display device of claim 8 including a converter coupled to the generating means for converting a pattern signal into a serial video signal.

14. The CRT display device of claim 8 including gating means for coupling the microprocessor means and the memory means for access thereto.

15. A character display system including a

CRT of long persistence light-emission time for displaying images on the screen thereof, memory means for storing data to be displayed, a central processing unit operably associated for accessing the memory means, a CRT controller operably associated for accessing the memory means to refresh images of data displayed on the screen of the CRT, control means for selecting access to the memory means by the central processing unit and the CRT controller, and generating means for producing output video signals dependent upon character data to be displayed, said control means operable to permit the CRT controller to read out data from the memory means and upon request from the central processing unit to enable such unit to access the memory means in preference over the CRT controller and to output a video inhibit signal to the generating means for a predetermined period of time and preventing output of video signals therefrom for such time.

16. The character display system of claim 15 wherein the memory means comprises a refresh memory for storing read and write data to be displayed and accessible by the CRT controller and by the central processing unit.

17. The character display system of claim 15 including parallel to serial converting means and wherein the generating means is a character generator coupled thereto and to the memory means and the converting means provides outputting of video signals to the CRT.

* * * * *